US008081892B2

(12) United States Patent
Taki et al.

(10) Patent No.: US 8,081,892 B2
(45) Date of Patent: Dec. 20, 2011

(54) IMAGE FORMING APPARATUS

(75) Inventors: Kenji Taki, Fuchu (JP); Chikatsu Suzuki, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 398 days.

(21) Appl. No.: 12/417,509

(22) Filed: Apr. 2, 2009

(65) Prior Publication Data

US 2009/0317108 A1 Dec. 24, 2009

(30) Foreign Application Priority Data

Apr. 8, 2008 (JP) ..... 2008-099960

(51) Int. Cl.
*G03G 15/16* (2006.01)

(52) U.S. Cl. ..... 399/66; 399/121; 399/302; 399/313

(58) Field of Classification Search ..... 399/9, 16, 399/31, 38, 66, 75, 121, 297–303, 308, 310, 399/313

See application file for complete search history.

(56) References Cited

U.S. PATENT DOCUMENTS 5,479,241 A * 12/1995 Hou et al. ..... 399/75
6,067,435 A * 5/2000 Soga et al. ..... 399/302

* cited by examiner

*Primary Examiner* — David Porta
*Assistant Examiner* — Benjamin Schmitt
(74) *Attorney, Agent, or Firm* — Finnegan, Henderson, Farabow, Garrett & Dunner, L.L.P.

(57) ABSTRACT

Bias correction control of an intermediate transfer belt 21 on which an image of each color formed on a surface of a photoconductive body 31 is transferred, and a second transfer belt 24 in pressure contact with the intermediate transfer belt 21 to transfer a toner image onto a recording sheet by passing the recording sheet between the intermediate transfer belt 21. Contents of the bias correction control (an amount of correction control and a cycle of correction control) can be changed in accordance with states of the belts i.e. whether the intermediate transfer belt 21 and the second transfer belt 24 are in a pressure contact state or a separate state.

11 Claims, 13 Drawing Sheets

FIG. 7

70

| BELT POSITION | BELT EDGE SECTION DETECTION | | STATUS | DETECTION CYCLE | |
|---|---|---|---|---|---|
| | PS1 | PS2 | | SEPARATING | CONTACTING WITH PRESSURE |
| LEFT SIDE | LIGHT INTERRUPTED | LIGHT INCOMING | 0 | 0.2 SEC. | 0.5 SEC. |
| ↕ | LIGHT INTERRUPTED | LIGHT INTERRUPTED | 1 | | |
| | LIGHT INCOMING | LIGHT INTERRUPTED | 2 | | |
| RIGHT SIDE | LIGHT INCOMING | LIGHT INCOMING | 3 | | |

FIG. 8

75

| TRANSITION STATUS | | DRIVING DIRECTION | NUMBER OF DRIVING STEPS | |
|---|---|---|---|---|
| BEFORE TRANSITION | AFTER TRANSITION | | SEPARATING | CONTACTING WITH PRESSURE |
| 1 | 2 | CCW | 25 | 30 |
| 2 | 3 | CCW | 25 | 30 |
| 1 | 0 | CW | 25 | 30 |
| 2 | 1 | CW | 25 | 30 |

FIG. 9

80

| STATUS | DRIVING DIRECTION | NUMBER OF DRIVING STEPS | | DRIVING CYCLE | |
|---|---|---|---|---|---|
| | | SEPARATING | CONTACTING WITH PRESSURE | SEPARATING | CONTACTING WITH PRESSURE |
| 0 | CW | 4 | 10 | 1 SEC. | 2 SEC. |
| 3 | CCW | 4 | 10 | | |

IMAGE FORMING APPARATUS

This application is based on Japanese Patent Application No. 2008-099960 filed on Apr. 8, 2008, in Japanese Patent Office, the entire content of which is hereby incorporated by reference.

TECHNICAL FIELD

The present invention relates to an image forming apparatus having a first transfer belt (intermediate transfer belt) to transfer a toner image formed on a surface of a photoconductive body and a second transfer belt to transfer the toner image on the first transfer belt onto a recording sheet by passing the recording sheet between the first transferable and the second transfer belt while pressing the recording sheet, and in particular to an image forming apparatus to carry out bias correction of the transfer belts.

BACKGROUND

An image forming apparatus such as a tandem type color copying machine using an electrophotographic process is provided with image forming sections, each configured with a photoconductive drum, a charging device, a scanning optical device and a developing device, respectively for yellow (Y), magenta (M), cyan (C) and black (K) colors along an endless intermediate transfer belt. The image forming apparatus is configured such that a toner image of each color Y, M, C and K is successively superimposed on the rotating intermediate transfer belt to form a color image, thereafter, the color image is transferred form the intermediate transfer belt to a recording sheet to be fixed and outputted.

Also, there is an image forming apparatus wherein a rotating endless second transfer belt to be in pressure contact with the intermediate transfer belt is disposed to face the intermediate transfer belt, and a toner image is transferred from the intermediate transfer belt to the recording sheet by passing the sheet between the intermediate transfer belt and the second transfer belt while pressing the recording sheet (for example, refer to Patent Document 1: unexamined Japanese patent application publication No. 2007-11107).

If bias or meandering of the intermediate transfer belt or the second transfer belt occurs while running, color shift occurs, resulting in deterioration of image quality. Therefore, a control to detect and correct the bias of the belt is popularly performed (Patent Document 1: unexamined Japanese patent application publication No. 2007-11107). For example, in Patent Document 1, bias correction is performed by swinging rollers on which the belt is installed while maintaining the distances between a plurality of the rollers (Refer to unexamined Japanese patent application publication No. 2007-11107). Also, in an image forming apparatus provided with an intermediate transfer belt and a second transfer belt, the bias correction is performed respectively for the intermediate transfer belt and the second transfer belt.

The intermediate transfer belt and the second transfer belt are configured to be changed between a pressure contact sate and a separate state, and for example, they contact one another with pressure only in a necessary period of image forming. Each belt runs independently in the separate state, however in the pressure contact state, one belt is affected by a running condition and the bias correction of the other belt. Therefore, if correction control is performed uniformly regardless of the pressure contact state or the separate state, there has been a problem that appropriate bias correction is difficult for both pressure contact state and separation state.

SUMMARY

The present invention has one aspect to resolve the above problem and an object of the present invention is to provide an image forming apparatus capable of bias correction to conform to the pressure contact state and the separate state for two transfer belts which can be changed between the pressure contact state and the separate state.

To attain the above object, a gist of the present invention exists in the following invention.

An image forming apparatus has: a first transfer belt to which an image formed on a surface of a photoconductive body is transferred, disposed to form a circle path; a first drive section to rotate the first transfer belt; a first detection section to detect a position of the first transfer belt in a width direction; a first moving section to move the first transfer belt in the width direction; a second transfer belt disposed to form a circle path in pressure contact with the first transfer belt to transfer a toner image on the first transfer belt onto a recording sheet by pressing the recording sheet between the first transfer belt while the recording sheet is passing between the first and second transfer belts; a second drive section to rotate the second transfer belt; a second detection section to detect a position of the second transfer belt in a width direction; a second moving section to move the second transfer belt in the width direction; a pressure contact switching section to switch between a pressure contact state in which the first transfer belt and the second transfer belt are in pressure contact and a separating state in which the belts thereof are separated; and a control section to control the pressure contact switching section, conduct correction control where biases of the first transfer belt and the second transfer belt are corrected by controlling operation of the first moving section and the second moving section in accordance with detected results of the first and the second detection sections, and change correction control for at least one of first moving section or the second moving section in according with whether the first belt and the second belt are in the pressure contact stats or in the separating state.

In the above invention, details (contents) of bias correction control for the above belts is changed in accordance with whether the first transfer belt and the second transfer belt are in the pressure contact state or the separate state. For example, an amount of correction (control amount) per correction operation and a cycle of correction control are changed.

BRIEF DESCRIPTION OF THE DRAWINGS

FIG. 7 is an explanatory diagram showing an example of a detection table.

FIG. 8 shows an example of a first control table.

FIG. 9 shows an example of a second control table.

DESCRIPTION OF THE PREFERRED EMBODIMENTS

Embodiments related to the present invention will be described as follow.

Figure 1:
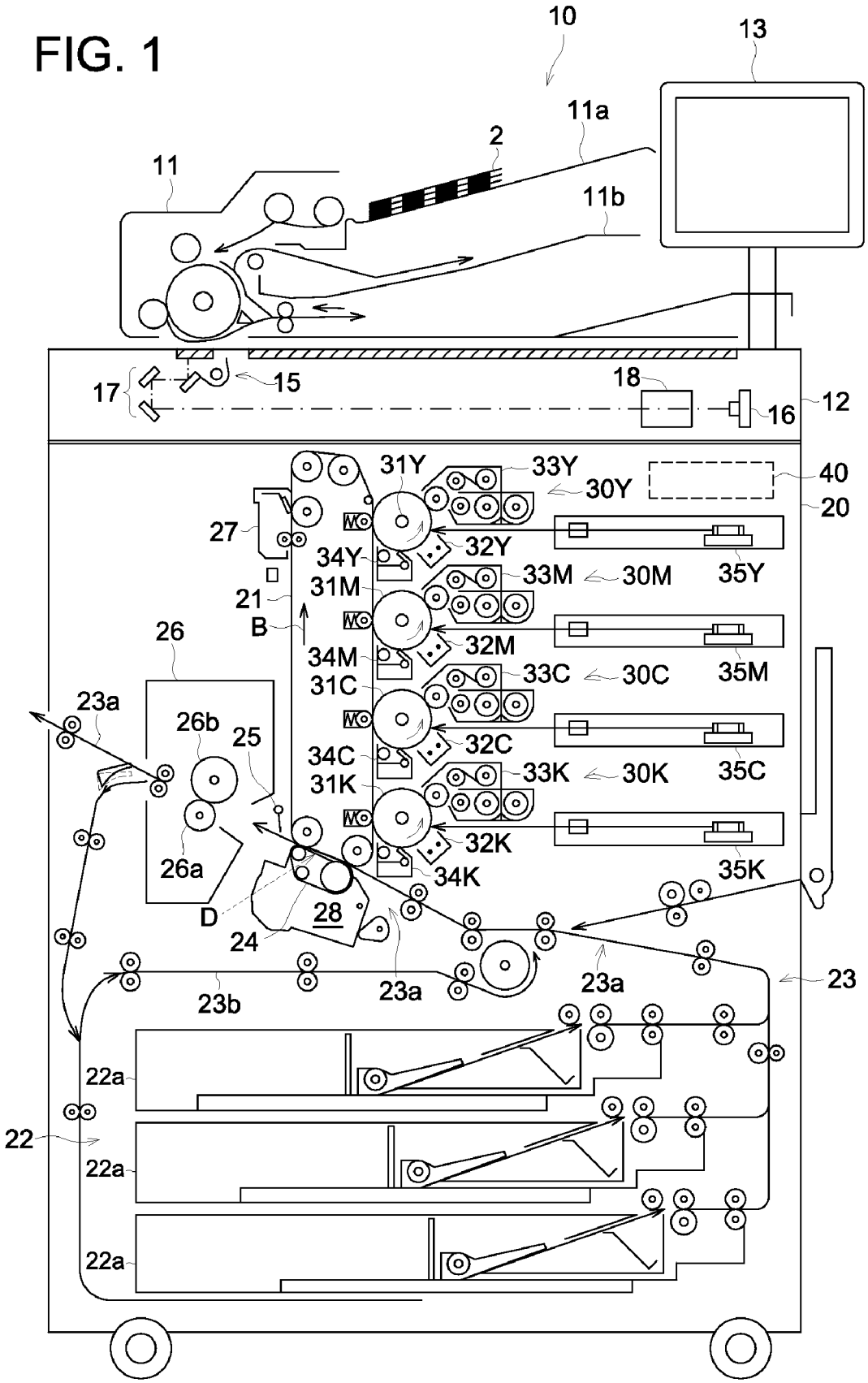
FIG. 1 is an explanatory diagram showing a cross-sectional structure of an image forming apparatus related to an embodiment of the present invention.

FIG. 1 shows a cross-sectional structure of an image forming apparatus 10 related to an embodiment of the present invention. The image forming apparatus 10 is an apparatus called a color digital copying machine provided with, a display operation section 13, a printer section 20, a substrate unit 40 and a reading section 12 having an automatic document feeding apparatus 11 (Refer to FIG. 1).

The automatic document feeding apparatus 11 (refer to FIG. 1) serves a function of feeding the document 2 stacked on a document loading tray 11*a* one by one to a reading position of a reading section 12, and ejecting the document having been read to a sheet ejection tray 11*b*.

The reading section 12 has a function to read the document with color. The reading section 12 is provided with an exposure scanning section 15 configured with a light source and a mirror, a color line image sensor 16 to receive reflected lights from the document and to output electric signals in accordance with light intensity for each color, and various kinds of mirrors 17 and collective lenses 18 to lead the reflected light from the document to the line image sensor 16.

The printer section 20 is a tandem type image forming apparatus provided with an intermediate transfer belt 21 which is a flat endless belt having a width wider than a transfer sheet, a plurality of image forming sections 30Y, 30M, 30C and 30K, each forms mono color image on the intermediate transfer belt 21, a sheet feeding section 22 to feed a transfer sheet (recording sheet), a conveyance section 23 to convey the transfer sheet fed, a second transfer belt 24 in an endless shape having substantially the same width as the intermediate transfer belt 21, a separation section 25, a fixing device 26 and a belt cleaning device 27. The second transfer belt 24 is capable of being separated from and coming in pressure contact with the intermediate transfer belt 21, to transfer the toner image on the intermediate transfer belt 21 onto the transfer sheet by passing the transfer sheet under presser between the intermediate transfer belt 21 and the second transfer belt 24 in a pressure contact state.

The image forming section 30Y forms a yellow (Y) color image on the intermediate transfer belt 21, the image forming section 30M forms a magenta (M) color image on the intermediate transfer belt 21, the image forming section 30C forms a cyan (C) color image on the intermediate transfer belt 21 and the image forming section 30K forms a black (K) color image on the intermediate transfer belt 21.

The image forming section 30Y is provided with a photoconductive body 31Y, a charging device 32Y, a developing device 33Y and a cleaning device 34Y which are dispose at a periphery of the photoconductive body 31Y. The photoconductive body 31Y represents an electrostatic latent image carrier in a cylindrical shape, having a surface on which an electrostatic latent image is formed. The image forming section 30Y is also provided with a laser diode to be on and off in accordance with image data, a writing unit 35Y configured with a polygon mirror and various kinds of lenses.

The photoconductive body 31Y is rotated in a predetermined direction (a direction of an arrow A) and driven by an illustrated drive section, and the charging device 32Y charges the photoconductive body 31Y in a positive polarity evenly. The writing unit 35Y serves a function to repeatedly scan the surface of the photoconductive body 31Y in a cylindrical shape in an axis direction (main scanning direction) thereof with the laser light by reflecting the laser light emitted from a laser diode with the rotating polygon mirror. By scanning the surface of the uniformly charged photoconductive body 31Y with the laser light which turns on and off in accordance with the image data of yellow color, an electrostatic latent image is formed on the photoconductive body 31Y.

The developing device 33Y visualizes the electrostatic latent image on the photoconductive body 31Y with tone of yellow color. Specifically, two-component toner charged in a positive polarity by an unillustrated power source in the developing device 33Y adheres on an electrostatic latent image portion on the surface of the photoconductive body 31Y by applying a positive developing bias, thereby a toner image is formed on the photoconductive body 31Y. The toner image is transferred onto the intermediate transfer belt 21 at a position where the intermediate transfer belt 21 is in pressure contact. The cleaning device 34Y serves a function to clean, remove and recover residual toner after transfer on the surface of the photoconductive body 31Y with a blade.

The image forming sections 30M, 30C and 30K have the same configuration as that of image forming section 30Y except that toner colors are different and the laser light is turned on and off in accordance with image data corresponding to each color, thus descriptions thereof are omitted. Meanwhile, in the figures, the same components for different colors have the same numerals with suffixes M, C and K instead of Y.

The intermediate transfer belt 21 is installed on a plurality of rollers to form a circular path and rotates in a direction of an arrow B in the figure while forming images. A color image is conflated by successively lapping the image (toner image) of each color in an order of (Y), (M), (C) and (K) in a process of orbit. The color image is transferred from the intermediate transfer belt 21 to the transfer sheet by an effect of an electrostatic force generated by a bias voltage in a polarity opposite to the toner applied by an unillustrated power source at a position (a transfer nip position D) where the second transfer belt 24 is in pressure contact with the intermediate transfer belt 21. The transfer sheet carrying the toner image is separated from the intermediate transfer belt 21 by discharging of a separating section 25 configured with a discharge needle. The belt cleaning device 27 removes the residual toner remaining on the intermediate transfer belt after transfer.

A sheet feeding section 22 is capable of two-sided printing, having a plurality of the sheet feeding cassettes 22*a* to store the transfer sheets to be served for printing. Sheet feeding section 22 serves a function to feed the transfer sheets one by one from a selected sheet feeding cassette 22*a* to a conveyance section 23. Besides a regular path 23*a* to pass the transfer sheet fed from the sheet feeding cassette 22*a* through the transfer nip section D and the fixing device 26 so as to eject the sheet to a sheet ejection tray outside the apparatus, the conveyance section 23 is provided with a reversal path 23*b* to turn over the transfer sheet passed through the fixing device 26 upside down and to merge the transfer sheet with a regular path 23*a* at an upstream side of the transfer nip section D. Meanwhile, the conveyance section 23 moves the transfer sheet to a position where a pair of registration rollers 23*c* is situated so as to align the front edge of the transfer sheet at the position, thereafter the transfer sheet is fed to the transfer nip section D at timing where the toner image (conflated color image) on the intermediate transfer belt 21 matches with an image position.

The printer section 20 performs printing in accordance with such a flow that the images of respective colors formed on the photoconductive bodies 31Y, 31M, 31C and 31K in accordance with image data are transferred primarily onto the intermediate transfer belt 21, and the image formed on the intermediate transfer belt by lapping is transferred through secondary transfer onto the transfer sheet at the transfer nip section D, then the transfer sheet is led to the fixing device 26 configured with a roller pair i.e. a pressure roller 26*a* and a heating roller 26*b* to fix the image on the transfer sheet, thereafter the transfer sheet is ejected.

Figure 2:
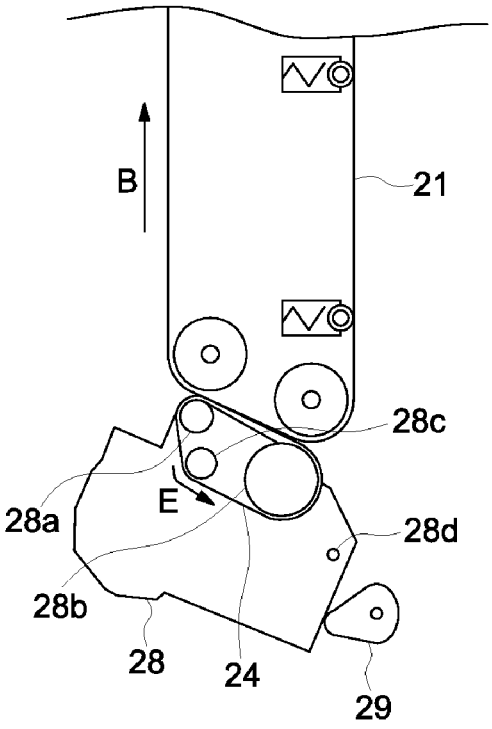
FIGS. 2(*a*) and 2(*b*) are explanatory diagrams showing a second transfer belt in a pressure contact state and in separate state in respect to the intermediate transfer belt.
Figure 2:
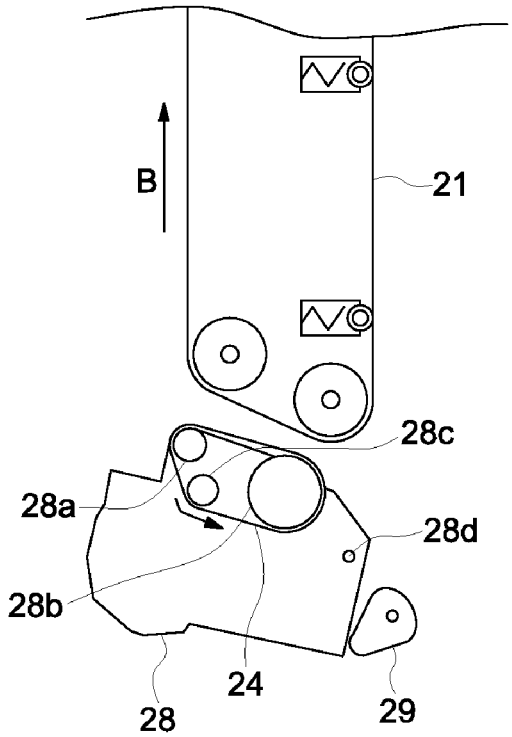

FIG. 2(*a*) shows a state where the second transfer belt 24 is in pressure contact with the intermediate transfer belt 24, and FIG. 2(*b*) shows a separate state. The second transfer belt 24 is installed on a drive roller 28*a*, a second transfer roller 28*b* and a steering roller 28*c* which are disposed at the second transfer unit 28 to form an orbital path. The second transfer unit 28 includes a second drive motor 55 to drive a drive roller 28*a*, a second sensor unit 56 to detect a position of the second transfer belt 24 in a width direction, a second stepping motor 57 to change an angle of an axis of a steering roller 28*c* which are omitted in FIGS. 2(*a*) and 2*b*.

The second transfer belt 24, disposed to face the intermediate transfer belt 24 at the same position in a width direction, is driven and rotated in an arrow E direction (an opposite direction to the rotation direction B of the intermediate transfer belt 21) in the figure. Also, the second transfer unit 28 is pivotally supported to swing centering around a pivot point 28*d*. The second transfer unit 28 as a whole swings centering around the pivot point 28*d* by a cam 29 in contact with a side section of the second transfer unit 28, between a pressure contact position (FIG. 2(*a*)) where the second transfer belt 24 is in pressure contact with the intermediate transfer belt 21 and a separate position (FIG. 2(*b*)) where the second transfer belt 24 is separated from the intermediate transfer belt 21. The cam 29 is driven and rotated by a cam drive motor 59. The cam 29 and the cam drive motor 59 configure a pressure contact changeover section to change the intermediate transfer belt 21 and the second transfer belt 24 between the pressure contact state and the separate state.

Figure 3:
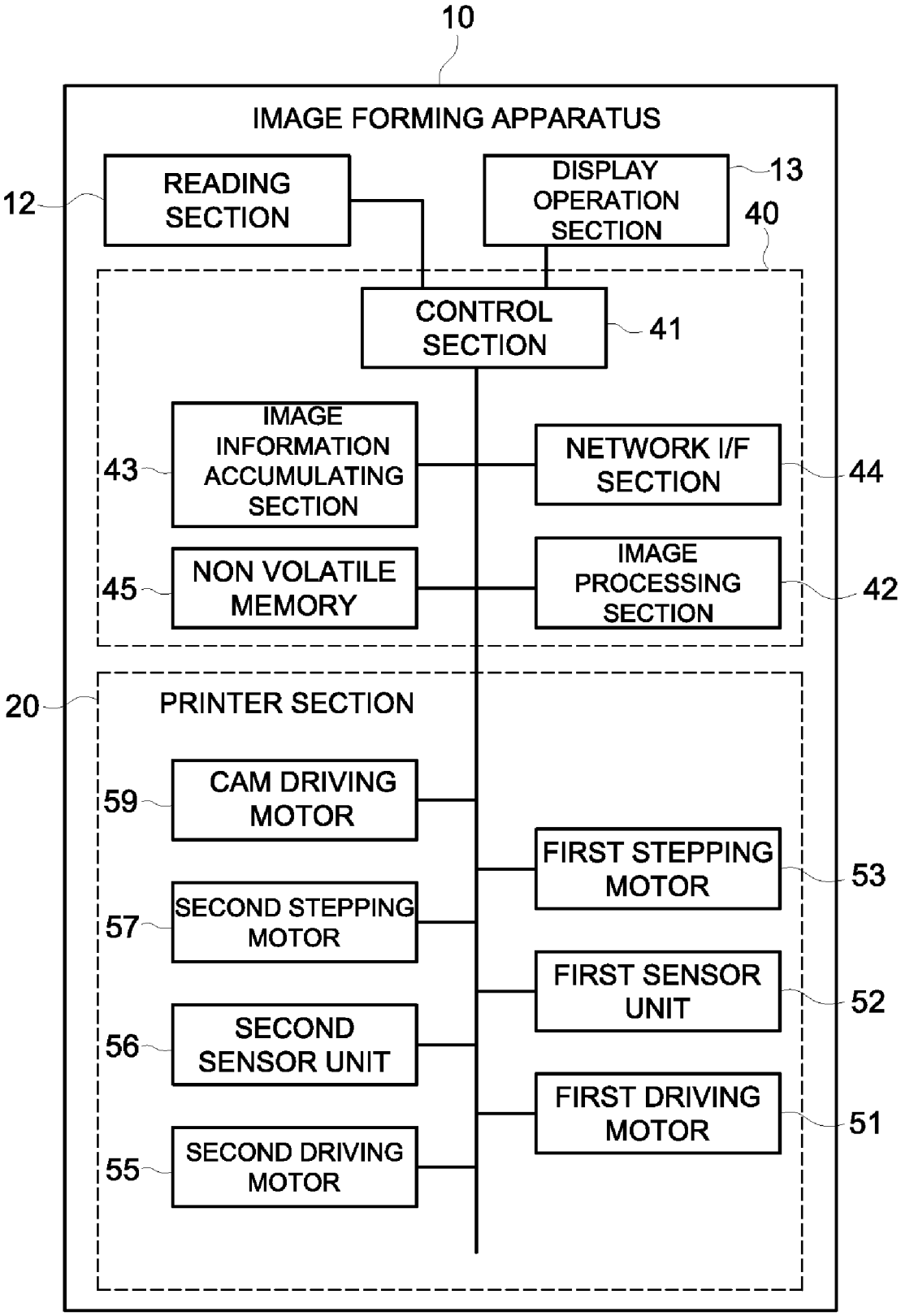
FIG. 3 is a block diagram showing an outline of an electric framework of the image forming apparatus related the present invention.

FIG. 3 is a block diagram showing an outline of an electrical configuration of the image forming apparatus 10. A substrate unit 40 is provided with a control section 41, an image processing section 42 connected with the control section 41, an image data accumulating section 43, a network I/F section 44 and a nonvolatile memory 45. A control section 41 to serve a function to control entire operation of the image forming apparatus 10 is configured with main components such as a CPU (Central Processing Unit), a ROM (Read only Memory) in which programs to be executed by the CPU and various kinds of fixed data are stored, a RAM (Random Access Memory) representing a work area where the CPU executes the program.

In addition, to the control section 41, a reading section 12, a display operation section 13, and a printer section 20 are connected. The display operation section 13 serves functions to receive various operations and settings from a user and to display various operation screens, setting screens and guide screens for the user. The display operation section 13 are configures with, for example, a liquid crystal display provided with a touch panel to detect pressed positions on the surface thereof and other switches.

The image processing section 42 serves a function that image data of each color inputted from a line image sensor 16 of the reading section 12 is subject to various image processes and compressed to be stored temporarily, thereafter image data of each color (Y), (M), (C) and (K) obtained by expanding the above data is outputted to each image forming section 30Y, 30M, 30C and 30K of the printer section 20. Also, the image processing section 42 serves a function to expand a raster image based on print data received from an external host computer via the network I/F section 44.

The image data accumulation section 43 serves a function to accumulate the image data created through the image processing section 42 by compressing or by expanding the raster image. The nonvolatile memory 45 is a memory to preserve memory contents though the power is turned off, in which control data for bias correction and various setting values are stored.

The control section 41 is further provided with a first drive motor 51 representing a drive section to rotate the intermediate transfer belt 21, a first sensor unit 52 representing a detection section to detect a position of the intermediate belt 21 in a width direction and a first stepping motor 53 representing a power source of a displacing section to displace the intermediate transfer belt 21 in the width direction. In addition, a second drive motor 55 representing a drive section to rotate a second transfer belt 24, a second sensor unit 56 representing a detection section to detect a position of the second transfer belt 24 in the width direction, the second stepping motor 57 representing a power source of the displacing section to displace the second transfer belt 24 in the width direction and a cam drive motor 59 to rotate the cam 29 are connected to the control section 41.

The control section 41 controls operation of the first and second stepping motors 53 and 57 in accordance with a detected results of the first and the second sensor units 52 and 56 so as to perform correction control to correct bias of the intermediate transfer belt 21 and the second transfer belt 24. Also, the control section 41 performs control of start/stop of rotation and rotation speed of the intermediate transfer belt 21 and the second transfer belt 24 through the first and second drive motors 51 and 55, and control of the intermediate transfer belt 21 and second transfer belt 24 to change between the pressure contact state and the separate state through the cam drive motor 59. Besides, the control section 41 controls sensors and drive motors related to the sheet feeding section 22, the conveyance section 23 and the fixing device 26 which are connected to the control section 41.

Figure 4:
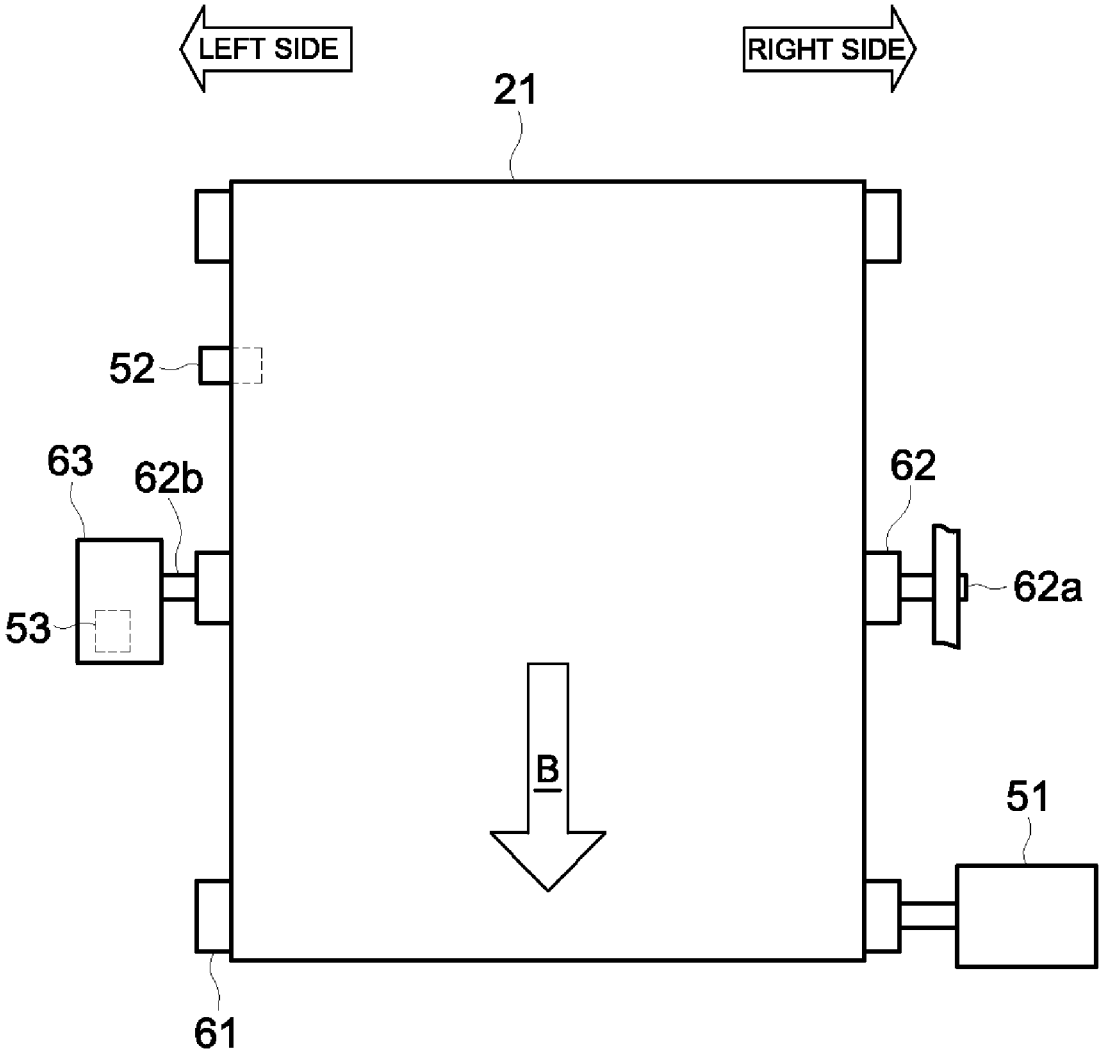
FIG. 4 is an explanatory diagram schematically showing a drive mechanism of an intermediate transfer belt.

FIG. 4 shows a drive mechanism of the intermediate transfer belt 21 schematically. The intermediate transfer belt 21 is installed on a plurality of rollers in a shape of a cylinder to form an orbital path (Refer to FIG. 1). The first displacing section to displace the intermediate transfer belt 21 in the width direction is configured with a steering roller 62 and a movable bearing section 63. The steering roller 62 is mounted in a movable manner so that an angle thereof can be changed centering around an end 62*a*, and the other end 62*b* of the steering roller 62 is supported by the movable bearing section 63 configured with gears and the first stepping motor 53. By rotating the first stepping motor 53 in a clockwise direction (CW) or an anticlockwise direction (CCW), the angle of the axis of the steering roller 62 can be adjusted in plus and minus direction in a predetermined angle range from a parallel state in respect to axes of a drive roller 61 and other rollers.

Also, at an end of the intermediate transfer belt 21 in the width direction, the first sensor unit 52 to detect the position of the intermediate transfer belt 21 in a width direction (bias state) is disposed.

Figure 5:
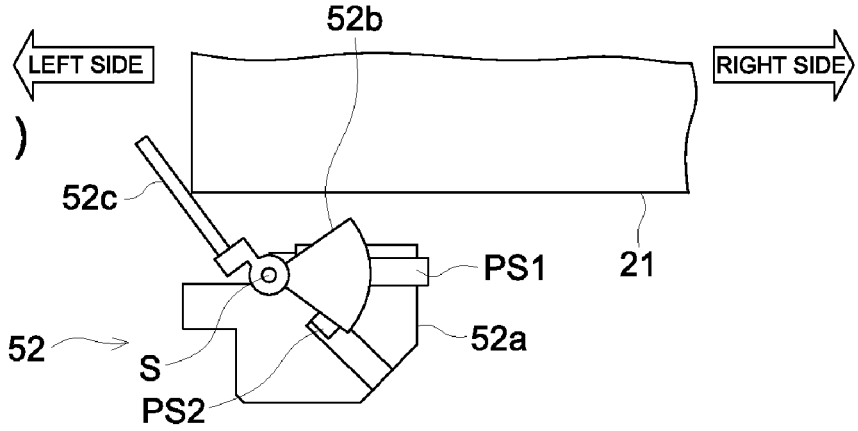
FIGS. 5(*a*), 5(*b*), 5(*c*), and 5(*d*) are explanatory diagrams showing operation and configuration of a first sensor unit.
Figure 5:
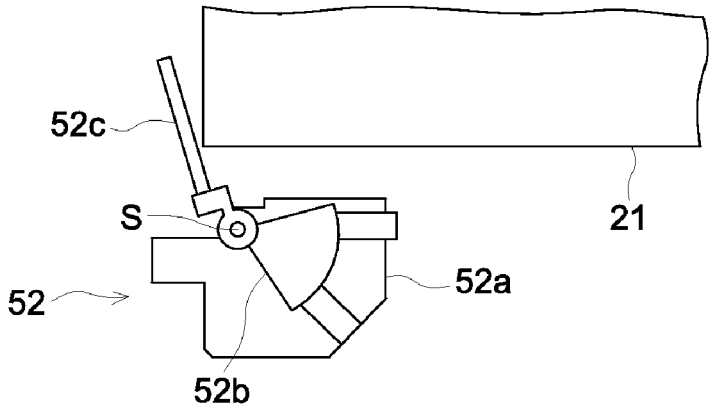
Figure 5:
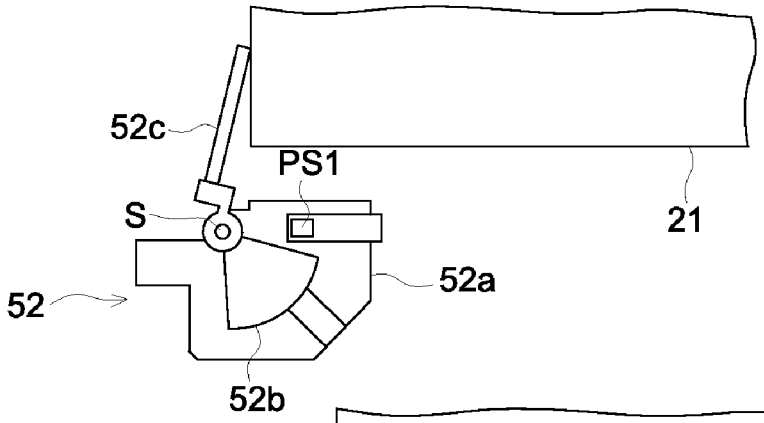
Figure 5:
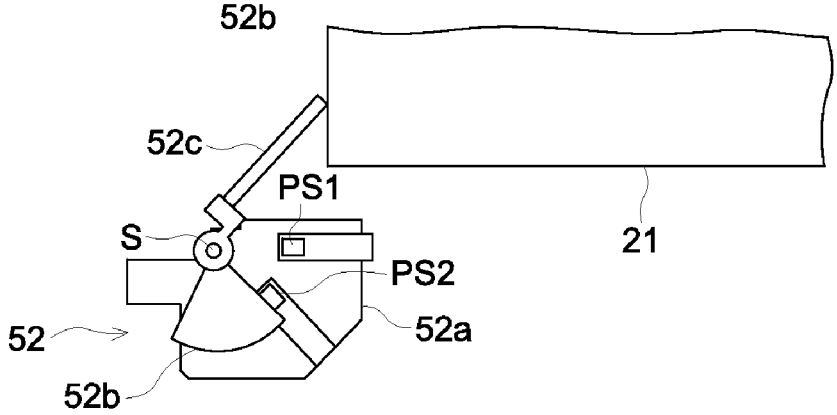

FIG. 5 shows a configuration and movement of the first sensor unit 52. The first sensor unit 52 is provided with a base 52*a*, a douser 52*b* in a shape of a delta mounted on the base 52*a* with a bearing rotatably at a center of the delta, and the first optical sensor PS1 and the second optical sensor PS2 mounted on the base 52*a* so as to realize a state of light interception by the douser 52*b* and a state of light coming in without interception in accordance with the rotation angle of the douser 52*b*.

The second optical sensor PS2 is disposed at a position distant form the first optical sensor SP1 by a predetermined angle centering around a center section S. Also, the douser 52B is provided with a contact arm 52C extended to an opposite side of the delta portion across the center section S. The contact arm 52*c* is in contact with one edge section of the intermediate transfer belt 21 in a width direction. There is disposed an unillustrated spring to bias the douser 52*b* to rotate in a direction (a direction of an arrow S in the figure) so that the contact arm 52*c* comes to contact with the edge section.

FIG. 5(*a*) shows a state that the intermediate transfer belt 21 is biased to a left side to a large extent (State 0: left to a large extent), where the first optical sensor PS1 and the second optical sensor PS2 are in a state of light coming in. FIG. 5(*b*) shows a state that the intermediate transfer belt 21 is slightly biased to the left side (state 1: slightly left) where the first optical sensor PS1 and the second optical sensor PS2 are intercepted. FIG. 5(*c*) shows a state that the intermediate transfer belt 21 is slight biased to a right side (state 2: slightly right), where the first optical sensor PS1 is in the state of light coming in and the second optical sensor PS1 is in the state of light intercepted. FIG. 5(*d*) is a state that the intermediate transfer belt 21 is biased to the right side to a large extent (state 3: right to a large extent), where the first optical sensor SP1 and the second optical sensor SP2 are in the state of light coming in.

The second sensor unit 56 to detect a position of the second transfer belt 24 in the width direction is configured in the same manner as the first sensor unit 52, therefore explanation thereof is omitted.

Figure 6:
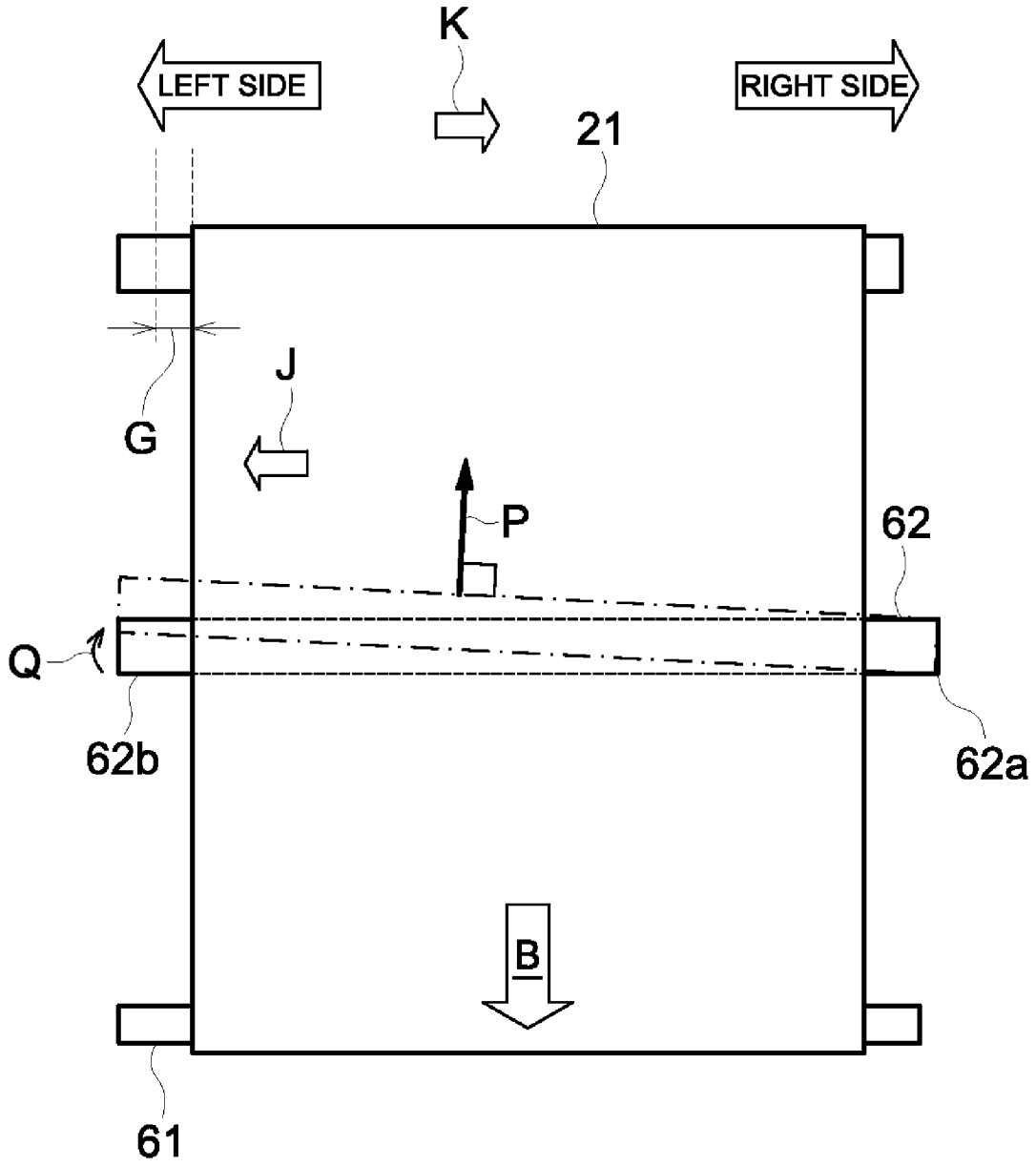
FIG. 6 is an explanatory diagram showing exemplary bias correction.

FIG. 6 shows a specific example of the correction control (hereinafter called steering control) where the position of the intermediate transfer belt 21 in the width direction is detected and corrected. The steering control for the intermediate transfer belt 21 is controlled to correct bias of the intermediate transfer belt 21 in the width direction and to bring the intermediate transfer belt 21 to a center position by changing a parallelism (inclination) of the axis of the steering roller 62 in respect to the axes of the drive roller 61 and other rollers through the first stepping motor 53. The steering control for the second transfer belt 24 is control to correct bias of the second transfer belt 24 in the width direction and to bring the second transfer belt 24 to a center position by changing a parallelism (inclination) of the axis of the steering roller 28*c* in respect to the axes of the drive roller 28*a* and the second transfer roller 28*b* through the second stepping motor 57.

In an example of FIG. 6, when the intermediate transfer belt 21 is biased to a bias direction J, control to change the parallelism (inclination) of the steering roller 62 is carried out so that the intermediate transfer belt 21 moves in a belt moving direction K opposite to the direction J. Given that an amount of change of the inclination of the steering roller 62 in respect to a state parallel to the drive roller 61 is a steering amount Q, by changing the inclination (parallelism) of the steering roller 62, a force is applied to the intermediate transfer belt 21 in a direction P in the figure and the intermediate transfer belt 21 moves in the width direction.

In a detection table 70 in FIG. 7, a first control table 75 of FIG. 8, and a second control table 80 of FIG. 9, various kinds of control data, which the control section 41 refers in the steering control are registered. In the detection table 70 of FIG. 7, control information indicating relations among a belt position, detecting states of the first optical sensor PS1 and the second optical sensor PS2, states of the belt (state 0 to 3) and a detection cycle is registered. According to the detection table 70, when the intermediate transfer belt 21 and the second transfer belt 24 are in a separate state (while separating), the position of the belt is detected in a cycle of 0.2 second to perform steering control, and when the intermediate transfer belt 21 and the second transfer belt 24 are in the pressure contact state (while contacting), the position of the belt is detected in a cycle of 0.5 second to perform the steering control.

Namely, the control cycle (detection cycle) differs with the pressure contact state and the separate state. The control cycle is shorter in the separating state than in pressure contact state, because a bias speed (a speed to move in width direction) is faster in the separating state.

In the first control table 75 of FIG. 8, control information indicating relations among transitions of states where the belt position changes from a state 1 or a state 2 to the other state, drive directions of the first and the second stepping motors 53 and 57, and number of drive steps is registered. A symbol CW in the figure denotes a drive direction of the stepping motors 53 and 57 when the parallelism is changed so as to move the belt to the right side, and a symbol CCW denotes the drive direction when the parallelism is changed so as to move the belt to the left side.

According to the first control table 75, in case the belt position in the state 1 or state 2 changes to the other state, the first stepping motor 53 or the second stepping motor 57 is driven. Also when the intermediate transfer belt 21 and the second transfer belt 24 are in the separating state (separated), the first stepping motor 53 or the second stepping motor 57 is driven by 25 steps in one steering control, and when the intermediate transfer belt 21 and the second transfer belt 24 are in the pressure contact state (under pressure contact) either of them are driven 30 steps.

Namely, the control amount in the steering control differs with the pressure contact state and the separate state. The number of the drive steps in the separate state is smaller than in the pressure contact state, because the belt moves in a large extent with a smaller displacing amount (displacement amounts of the angles of the axes of the rollers 62 and 28*c*) in the separate state.

In the second control table 80 of FIG. 9, there is registered control information indicating relations among drive directions of the first and the second stepping motors 53 and 57 in the state 0 and the state 3, the number of the drive steps and the drive cycle. When the belt is biased to the left in a large extent (state 0) or to the right in a large extent (state 3), the motor is driven by a predetermined number of steps repeatedly in each predetermined cycle not only in transition of the states so as to hasten to return the belt to the center section.

In the second control table 80, the following control contents are registered. (1) In the state 0 (considerably left), where the intermediate transfer belt 21 and the second transfer belt 24 are in the pressure contact state, operation to drive the first stepping motor 53 or the second stepping motor 57 by four steps in the CW direction (direction to move right) is repeated every one second.

(2) In the state 0, where the intermediate transfer belt 21 and the second transfer belt 24 are in the separated, operation to drive the first stepping motor 53 or the second stepping motor 57 by ten steps in the CW direction is repeated every two seconds.

(3) In the state 3 (considerably right), where the intermediate transfer belt 21 and the second transfer belt 24 are in the pressure contact state, operation to drive the first stepping motor 53 or the second stepping motor 57 by four steps in the CCW direction (direction to move left) is repeated every one second.

(4) In the state 3, where the intermediate transfer belt 21 and the second transfer belt 24 are in the separate state, operation to drive the first stepping motor 53 or the second stepping motor 57 by ten steps in the CCW direction is repeated every two seconds.

Meanwhile, in the second control table 80, the number of drive steps and the drive cycle also differ with the pressure contact state and the separate state, because the belt moves in a large extent with a smaller displacement amount (control amount) in the separate state and faster in the separate state than in the pressure contact state.

The control section 41 compares a belt position detected last time with a belt position detected this time so as to determine contents of control to be performed in this time's steering control in accordance with the detection table 70, the first control table 75 and the second control table 80. Meanwhile, in case an additional sensor is further provided and the sensor detects that the belt is biased to the left beyond the state 0, the stepping motors 53 and 57 to correct the bias of the belt are prohibited to be driven in the CW direction and in case the sensor detects that the belt is biased to the right beyond the state 3, the stepping motors 53 and 57 to correct the bias of the belt are prohibited to be driven in the CCW direction. The drive is prohibited so as not to carry out correction since a large bias deemed to be abnormal. In case of prohibiting, an error is appropriately announced to be reported to the user, then correction is carried out manually.

A detailed flow of the steering control will be described based on the FIG. 10, FIG. 11 and FIG. 12. Meanwhile, since the flows of the steering control of the intermediate transfer belt 21 and the steering control of the second transfer belt 24 are the same, an example where the intermediate transfer belt 21 is subject to the steering control will be described here.

Upon satisfaction of the conditions such as "warming up starts" or "printing operation of the printer section 20 starts", the control section 41 starts to rotate (orbit) the intermediate transfer belt 21 (Step S101). Next, The position (state 0 to 3) of the intermediate transfer belt 21 is detected by the first sensor unite 52, the state 0 to 3 corresponding to the detection result is sought from the detection table 70 and a belt state flag is set with the state (Step S102).

Next, the position of the intermediate transfer belt 21 is detected again to seek the state (Step S103). In case of state 0 (left end) or state 3 (right end), after the belt state flag is set with the state of the intermediate transfer belt 21 detected this time (current state) (Step S104), the steering control is carried out in accordance with the second control table 80.

Namely, whether the intermediate transfer belt 21 and the second transfer belt 24 are in the pressure contact state or the separate condition is judged, and if it is in the pressure contact condition (Step S105; pressure contact), the first stepping motor 53 is driven by 10 steps (Step S106) in a direction to move the intermediate transfer belt 21 in an opposite direction to the current position (if the current state is state 3, the CCW direction, and if state 0, the CW direction). After two seconds (Step S107), the flow returns to step S103. If the intermediate transfer belt 21 and the second transfer belt 24 are in the separate condition (Step S105: Separated), the first stepping motor 53 is driven by 4 steps (Step S108) in a direction to move the intermediate transfer belt 21 in an opposite direction to the current position (if the current state is state 3, the CCW direction, and if state 0, the CW direction), then after one second (Step S109), the flow returns to step S103. Therefore, while being in the state 3, correction is repeated with intervals of two seconds and one second.

In case the position (state) of the intermediate transfer belt 21 detected in step S103 is slightly right (state 2) (Step S103; 2: slightly right), the flow moves to step S110 to check the belt state flag (last belt position). In case the belt state flag shows the state 3 (Step S110; 3: right end), after the belt state flag is renewed to be the state 2 which is a current state (Step S111), whether the pressure contact condition or the separated condition is judged (Step S112). If it is in the pressure contact condition, the first stepping motor 53 is driven by 30 steps in the left direction (CCW) (Step S113) and the flow moves to step S130. In case of the separate state, the first stepping motor 53 is driven by 25 steps (Step S114) in the left direction and the flow moves to steps S130. Namely, when the state is changed from the right to the left, the steering control is performed only one more time so as to move to the left side.

In case the belt state flag is in the state 1 or the state 0 (Step S110; 0: left end, 1: slightly left), after the belt state flag is renewed to be the state 2 representing the current state (Step S115), whether the pressure contact state or the separate state is judged (Step 116), then if it is the pressure contact state, the first stepping motor 53 is drive by 30 steps in the right direction (CW) (Step S117) and the flow moves to S130. If it is the separate state, the first stepping motor 53 is driven by 25 steps in the right direction (Step S118) and the flow moves to step S130. Namely, when the state shifts from the left to the right, the steering control is performed only one more time so as to move to the right side.

In case the belt state flag is the state 2 (Step S110; state 2), since the state does not shift, the first stepping motor 53 is not driven without changing parallelism, and the flow moves to the step S130.

Figure 12:
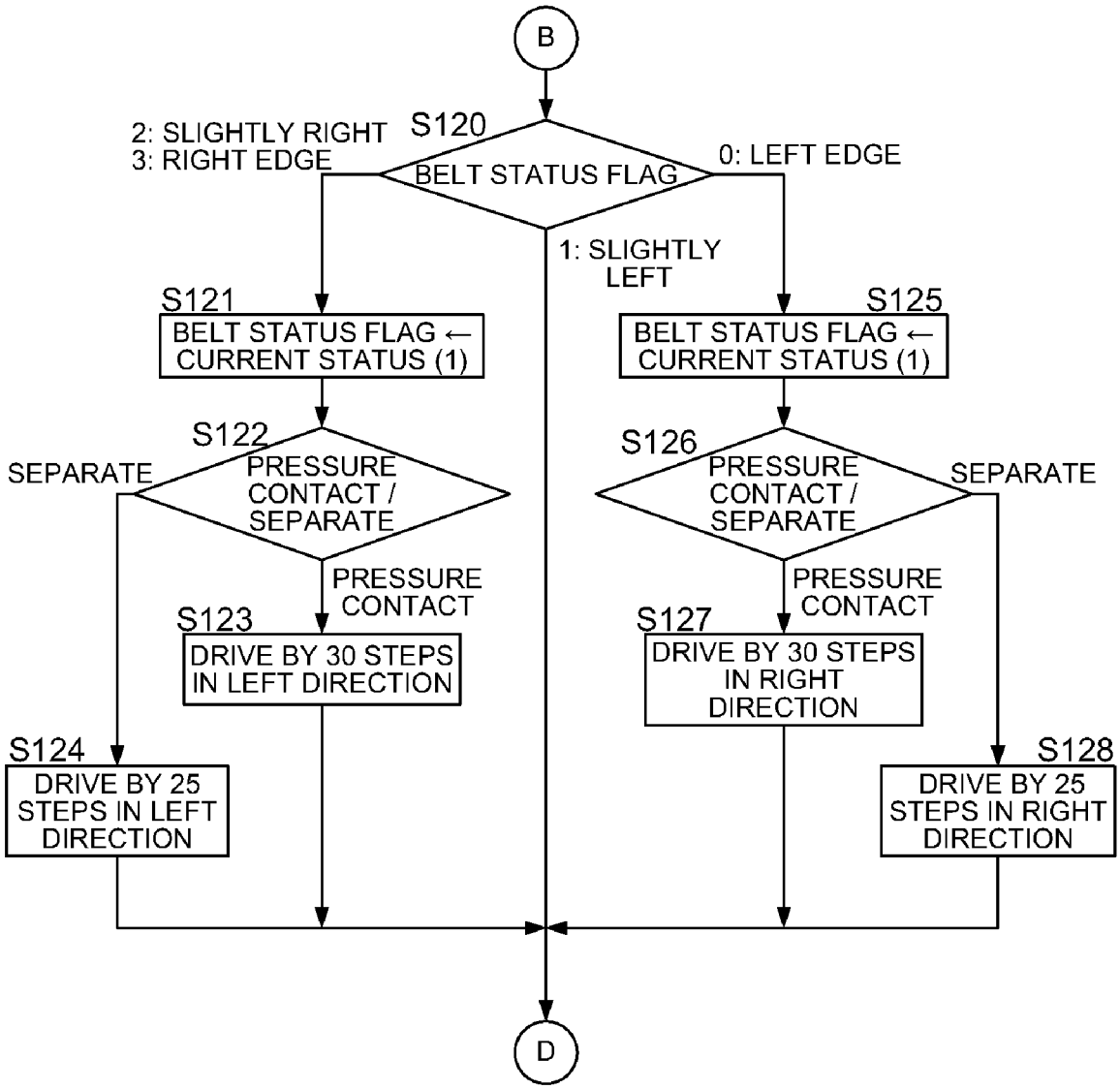
FIG. 12 is a flow chart showing a continuation of FIG. 10.

In case the position (state) of the intermediate transfer belt 21 detected in step S103 is slightly left (state 1) (Step S103; 1: slightly left), the flow moves to step S120 in FIG. 12 to check the belt state flag (last belt position). In case the belt state flag shows state 3 (Step S120; 2: slightly right, 3: right end), after the belt state flag is renewed to be the state 1 which is a current state (Step S121), whether the pressure contact condition or the separated condition is judged (Step S122). If it is judged to be the pressure contact condition, the first stepping motor 53 is driven by 30 steps in the left direction (Step S123) and the flow moves to step S130. In case of the separate state, the first stepping motor 53 is driven by 25 steps (Step S124) in the left direction and the flow moves to steps S130.

In case the belt state flag is the state 0 (Step S120; 0: left end), after the belt state flag is renewed to be the state 1 representing the current state (Step S125), whether the pressure contact state or the separate state is judged (Step 126), then if it is in the pressure contact state, the first stepping motor 53 is drive by 30 steps in the right direction (Step S127) and the flow moves to S130. If it is in the separate state, the first stepping motor 53 is driven by 25 steps in the right direction (Step S128) and the flow moves to step S130.

In case the belt state flag is the state 1 (Step S120; state 1), since the state does not change, the first stepping motor 53 is not driven without changing parallelism and the flow moves to the step S130.

Figure 10:
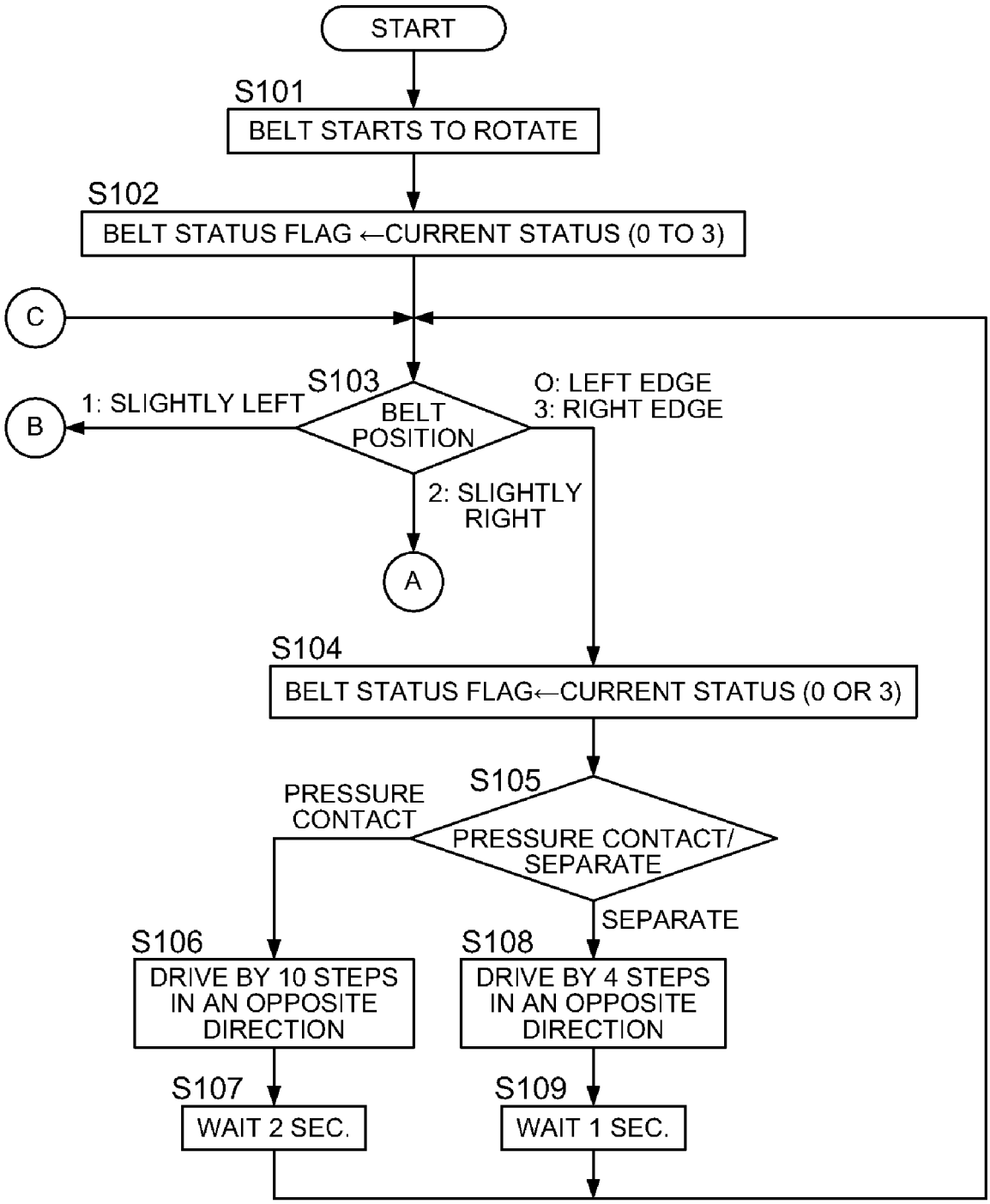
FIG. 10 is a flow chart showing a flow of steering control.
Figure 11:
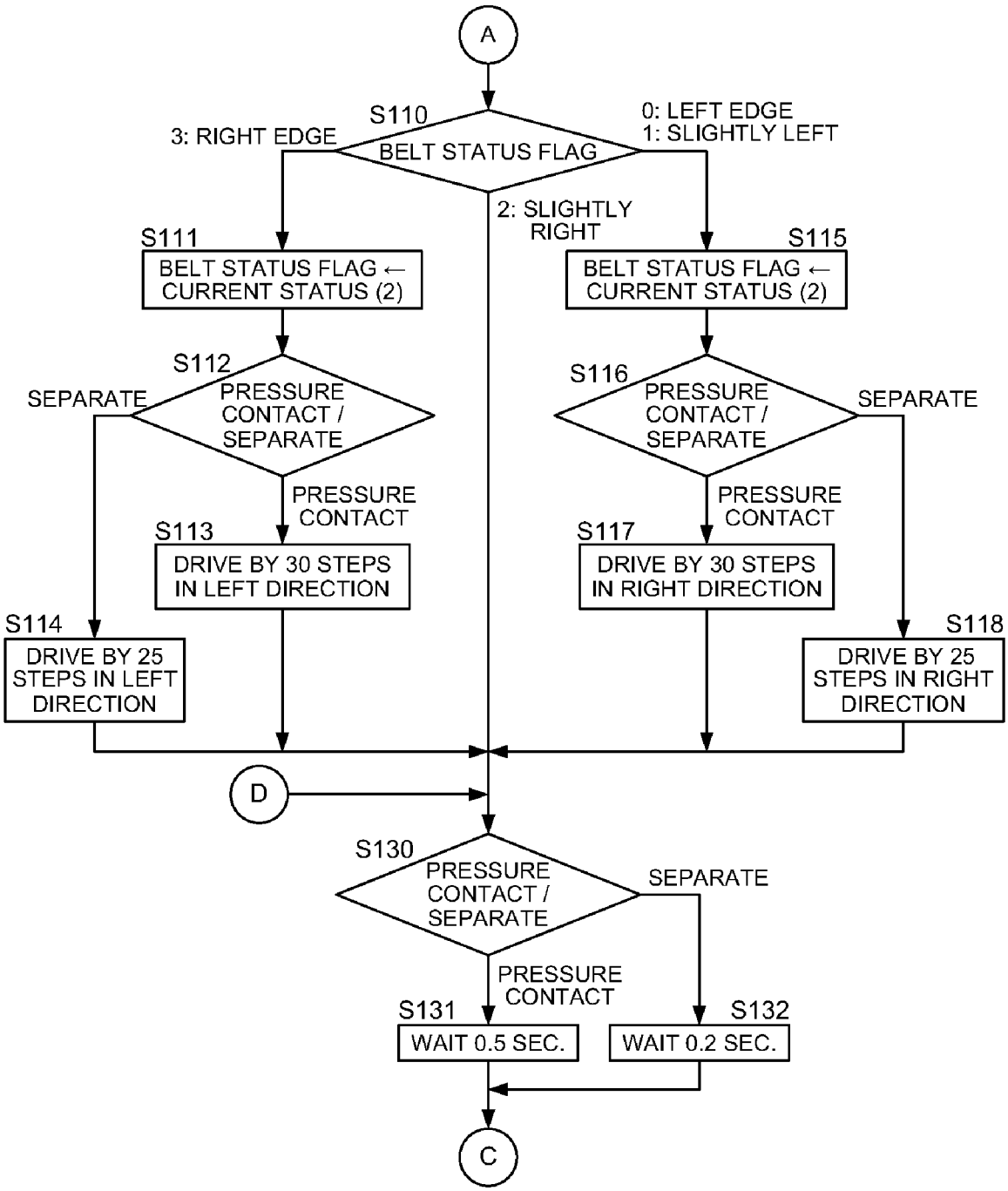
FIG. 11 is a flow chart showing a continuation of FIG. 10.

In step S130, whether the intermediate transfer belt 21 and the second transfer belt 24 are in the pressure contact state or the separate state is judged, and in case of the separate state (Step S130; separate state), after waiting for 0.2 seconds which represents the control cycle in the separate state (Step S132), the flow returns to step S103 in FIG. 10. In case of the pressure contact state (Step S130; pressure contact), after waiting for 0.5 seconds which represents the control cycle in the pressure contact (Step S131), the flow returns to step S103 in FIG. 10.

Meanwhile, the control section 41 reduces the orbiting speed of the intermediate transfer belt 21 and the second transfer belt 24 in the separate state compare to that in the pressure contact state. For example, the orbiting speed in the separate state is a half of the speed in the pressure contact state. Because, a bias speed of the belt tents to be faster in the separate state, and the steering control may not catch up, thus by reducing the orbiting speed of the belt in the separate state, the bias speed is reduced.

Figure 13:
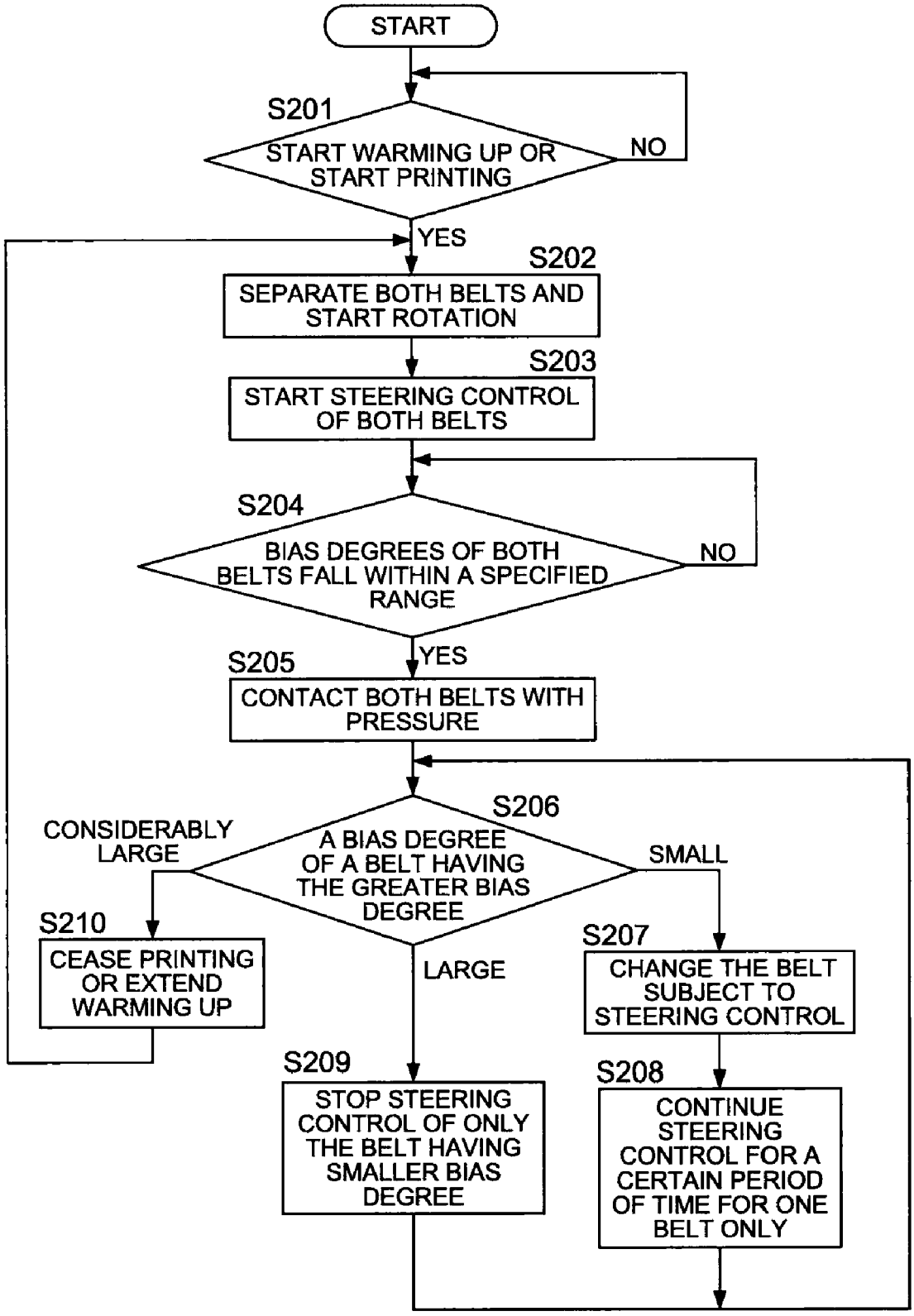
FIG. 13 is a flow chart showing entire control related to bias corrections of an intermediate transfer belt and a second transfer belt.

FIG. 13 shows a flow of entire control related to correction of the bias of the intermediate transfer belt 21 and the second transfer belt 24. In a state of staring warming up when the power of the image forming apparatus 10 is turned on or in a state of printing start (Step S201, Y), the control section 41 starts to rotate (orbit) both belts in a low speed rotation mode where the intermediate transfer belt 21 and the second transfer belt 24 are in the separate state (Step S202). Also, the control section 41 starts the steering control according to the flow shown in the FIGS. 10 to 12 for both belts (Step S203) and continues the steering control and rotation until the biases of both belts 21 and 24 fall within a predetermined range (Step S204; N). Meanwhile, the predetermined range can be determined respectively for the intermediate transfer belt 21 and the second transfer belt 24. Namely, it can be configured such that when the intermediate transfer belt 21 falls within a first predetermined range and the second transfer belt 24 falls within a second predetermined rage, both belts are allowed to be in the pressure contact.

When the biases of both belts 21 and 24 fall within the predetermined ranges (Step S204; Y), pressure contact of the intermediate transfer belt 21 and the second transfer belt 24 is allowed and the belts come in pressure contact (Step S205). After coming in pressure contact, the low rotation speed mode is changed to a regular rotation mode which is faster in the orbiting speed of the intermediate transfer belt 21 and the second transfer belt 24 than the orbiting speed of the low rotation sped mode.

In the pressure contact state, the bias of the intermediate transfer belt 21 or the second transfer belt 24 whichever is greater in the biases is focused. Then a first criterion value and a second criterion value (the first criterion value<the second criterion value) are set. Using the criteria, whether the bias of the belt focused is considerably large (larger than the second criterion value), large (larger than the second criterion value and smaller than the first criterion value) or small (less that the first criterion value) is judged (Step S206).

In case the bias is smaller than the first criterion value (Step S206; small), the steering control for the intermediate transfer belt 21 and the second transfer belt 24 are performed alternately for a predetermined time respectively. Namely, the belt subject to the steering control is changed (Step S207) and the steering control is performed only the belt subject to the steering control for a predetermined time (Step S208), thereafter the flow returns to step S206. The predetermined time can be set based on a running distance of the belt (namely, the predetermined time varies with the orbiting speed).

In case the bias of the belt greater in the bias is smaller that the second criterion and greater than the first criterion (Step S206, large), only the steering control for the belt smaller in the bias is ceased and the steering control for the belt greater in the bias is continued (Step S209), then the flow returns to step S206.

In case the bias of the belt greater in the bias is greater that the second criterion value (Step 206, considerably large), the steering control is judged to be impossible and printing operation is interrupted or warming up is continued (Step S210), then the flow returns to step S202 to separate the belts each other once.

In the pressure contact state, if the steering controls for the intermediate transfer belt 21 and the steering control for the second transfer belt 24 are performed simultaneously, both belts are affected by the steering control of the other belt one another and appropriate bias correction becomes difficult. Also, in the pressure contact state, if only one belt is subject to the steering control from the beginning to the end, the bias of the other belt cannot be controlled at all, which possibly causes a large bias or running off from the rollers.

In the embodiment of the present invention, in the pressure contact state, the simultaneous steering control for the intermediate transfer belt 21 and the second transfer belt 24 are prohibited. In case the degree of the bias is small, the steering control is carried out for both belts alternately for a predetermined time, and the degree of the bias is greater than a certain level, the steering control is concentrate on one belt until the degree of the bias becomes small.

Thereby, the belt subject to the steering control is not affected by the steering control of the other belt. Also, in case of the degree of the bias is small, by changing the belt subject to the steering control alternately, a large bias of the belt and running out of the belt due to a non control state for a long period of time can be avoided. Further, in case the degree of the bias is considerably large, the steering control is continued only for the belt unit the degree of the bias becomes small, therefore the large bias can be corrected in a short time. Also, in case the bias is too large to carry out the steering control, the belts are separated once, so that each belt can be controlled to correct the bias without being affected by others.

Also, while the biases of both belts 21 and 24 do not fall within the predetermined rage, pressure contact of both belts is prohibited, and when the biases of both belts 21 and 24 fall within the predetermined rage, pressure contact is allowed. Whereby, since the degree of the biases at the time of contacting is small, control in the pressure contact state becomes easy. Also, since the degrees of the biases of both transfer belts 21 and 24 can be reduced in the separate state where the correction control is possible without being affected one another, the biases can be reduced in a short time.

In the forgoing, the embodiment of the present invention has been described with reference to the drawings, specific configuration is not limited by the embodiment thereof, and it is to be understood that changes and variations may be made without departing from the spirit or scope of the appended claims.

In the embodiments, while the steering control is performed by detecting the degree of the bias with four steps (state 0 to state 3), the steering control can be performed more finely by detecting the bias with more steps. Also, the detecting method of the bias is not limited to the exemplified embodiments.

Also, the detection cycle and the number of drive steps indicated in the embodiment are examples only and can be changed appropriately. For example, the detection cycles were 0.5 seconds in the pressure contact state and 0.2 seconds in the separate state irrespective of conditions, however, the detection cycles in the pressure contact state and the separate state can be changed and set finely in accordance with each condition of the belt. The number of drive steps also can be set in the same manner.

The mechanism to correct the belt bias is not limited to the exemplified embodiments, and any discretional mechanism serving the same function can be used.

Also, the detection cycle and the number of the drive steps can be set and changed through the display operation section 13.

In the embodiment, while the control section 41 conducts the entire control, a plurality of control sections can conduct dispersion control. Also, the image forming apparatus 10 is not limited to the multifunction peripheral. The image forming apparatus 10 can be a printer or a facsimile machine, as far as they transfer an image onto the transfer sheet utilizing the intermediate transfer belt 21 and the second transfer belt 24 to be in pressure contact with the intermediate transfer belt 21.

According to the image forming apparatus related to the present invention, the bias correction control can be performed for two belts which can be changed between the pressure contact state and the separate state in accordance with the pressure contact state and the separate state appropriately.

What is claimed is:

1. An image forming apparatus, comprising:

a first transfer belt to which an image formed on a surface of a photoconductive body is transferred, disposed to form a circle path;

a first drive section to rotate the first transfer belt;

a first detection section to detect a position of the first transfer belt in a width direction;

a first moving section to move the first transfer belt in the width direction;

a second transfer belt disposed to form a circle path in pressure contact with the first transfer belt to transfer a toner image on the first transfer belt onto a recording sheet by pressing the recording sheet between the first transfer belt while the recording sheet is passing between the first and second transfer belts;

a second drive section to rotate the second transfer belt;

a second detection section to detect a position of the second transfer belt in a width direction;

a second moving section to move the second transfer belt in the width direction;

a pressure contact switching section to switch between a pressure contact state in which the first transfer belt and the second transfer belt are in pressure contact and a separating state in which the belts thereof are separated; and a control section to control the pressure contact switching section, conduct a correction control where biases of the first transfer belt and the second transfer belt are corrected by controlling an operation of the first moving section and the second moving section in accordance with detected results of the first and the second detection sections, and change the correction control for at least one of the first moving section or the second moving section in accordance with whether the first belt and the second belt are in the pressure contact state or in the separating state.

2. The image forming apparatus of claim 1, wherein the control section changes a correction amount to be smaller in the separating state compared to that in the pressure contact state.

3. The image forming apparatus of claim 1, wherein the control section shortens a cycle of the correction control in the separating state compare to that in the pressure contact state.

4. The image forming apparatus of claim 1, wherein the control section slows rotating velocities of the first transfer belt and the second transfer belt in the separating state compared to the pressure contact state.

5. The image forming apparatus of claim 1, wherein the first transfer belt and the second transfer belt are respectively disposed on a plurality of rollers, and the first moving section and the second moving section change a degree of parallelization between the plurality of the rollers so as to move the transfer belts in the width directions.

6. The image forming apparatus of claim 1, wherein the control section conducts the correction control for one of the first transfer belt or the second transfer belt when the first transfer belt and the second transfer belt are in the pressure contact state.

7. The image forming apparatus of claim 6, wherein when the first transfer belt and the second transfer belt are in the pressure contact state, the control section conducts the correction control for the first transfer belt or the second transfer belt, whichever is greater in a bias and ceases the correction control for the other transfer belt.

8. The image forming apparatus of claim 6, wherein when the first transfer belt and the second transfer belt are in the pressure contact state, the control section conducts the correction control for the first transfer belt and the second transfer belt alternately in a cyclic manner.

9. The image forming apparatus of claim 6, wherein when the first transfer belt and the second transfer belt are in the pressure contact state, the control section conducts the correction control for the first transfer belt and second transfer belt alternately in a cyclic manner, in case the bias of the first transfer belt or the second transfer belt whichever is greater in the bias is less than a first criterion vale, and the control section conducts the correction control for the first transfer belt or second transfer belt whichever is greater in the bias, in case the bias of the first transfer belt or the second transfer belt whichever is greater is not less than a first criterion vale, and ceases the correction control for the other transfer belt.

10. The image forming apparatus of claim 1, wherein in the separating state wherein the first transfer belt and the second transfer belt are separated, only in case the bias of the first transfer belt falls within a first specified range and the bias of the second transfer belt falls within a second specified range, the first transfer belt and the second transfer belt are allowed to be in the pressure contact with each other.

11. The image forming apparatus of claim 1, wherein in the pressure contact state, the bias of first transfer belt or the second transfer belt whichever is greater is out of an allowable range, the first transfer belt and the second transfer belt are separated from each other.

* * * * *